US007377043B2

(12) United States Patent
Tsai

(10) Patent No.: US 7,377,043 B2
(45) Date of Patent: May 27, 2008

(54) SHEARING APPARATUS

(75) Inventor: Eric Tsai, Tali (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 0 days.

(21) Appl. No.: 11/427,442

(22) Filed: Jun. 29, 2006

(65) Prior Publication Data

US 2007/0101583 A1 May 10, 2007

(30) Foreign Application Priority Data

Aug. 11, 2005 (TW) ..... 94127378 A

(51) Int. Cl.

| | |
|---|---|
| ***B62B 13/00*** | (2006.01) |
| ***B62B 1/00*** | (2006.01) |
| ***B62B 3/00*** | (2006.01) |
| ***B62B 11/00*** | (2006.01) |
| ***B62B 3/06*** | (2006.01) |

(52) U.S. Cl. ..... 30/244; 30/345; 30/255; 30/135; 30/162

(58) Field of Classification Search ..... 30/244, 30/245, 131, 142, 143, 151, 152, 154, 252–255, 30/162, 135, 123, 153, 353
See application file for complete search history.

(56) References Cited

U.S. PATENT DOCUMENTS

| | | | | |
|---|---|---|---|---|
| 4,502,220 | A * | 3/1985 | Aoki | 30/154 |
| 4,783,867 | A * | 11/1988 | Tsao | 7/160 |
| 4,791,725 | A * | 12/1988 | Amagaya | 30/154 |
| 4,794,692 | A * | 1/1989 | Wang | 30/123 |
| 5,357,678 | A * | 10/1994 | Wei | 30/255 |
| 5,511,262 | A * | 4/1996 | Horng | 7/160 |
| 6,964,099 | B1 * | 11/2005 | Zeng | 30/254 |
| 2004/0034937 | A1 * | 2/2004 | Ackeret | 7/160 |
| 2005/0081386 | A1 * | 4/2005 | Chang | 30/151 |

OTHER PUBLICATIONS

Taiwanese Patent Publication No. 560398, Nov. 1, 2003, 6 pages.

* cited by examiner

*Primary Examiner*—Joseph J. Hail, III
*Assistant Examiner*—Bryan R. Muller
(74) *Attorney, Agent, or Firm*—Alan Kamrath; Kamrath & Associates PA

(57) ABSTRACT

A shearing apparatus includes a pair of scissors including a first blade, a second blade, a first slide on the first blade and a second slide on the second blade. A first handle defines a groove for receiving the first slide, a first portion through which the pair of scissors can be retracted into and extended from the first handle, a second portion, a slot and two apertures in communication with the slot. A second handle is pivotally connected to the first handle. The second handle defines a groove for receiving the second slide. A positioning device is connected to the pair of scissors. The positioning device is normally located in one of the apertures to position the pair of scissors and can be pushed and then moved between the apertures along the slot to move the pair of scissors.

19 Claims, 14 Drawing Sheets

3- 3

4- 4

11 - 11

13 - 13

SHEARING APPARATUS

BACKGROUND OF INVENTION

1. Field of Invention

The present invention relates to a searing apparatus and, more particularly, to a pair of scissors.

2. Related Prior Art

In Taiwanese Patent Publication No. 560398, there is disclosed a shearing apparatus including a pair of scissors, two slides and two handles. The pair of scissors includes two blades formed with shanks. The shanks define apertures. Each slide includes a groove for receiving the shank, an aperture in communication with the groove, a recess and two screw holes. A pin is fit in the aperture through the aperture of one of the slides. A rivet is inserted in the handles and a torque spring between the handles. The handles are joined by the pin. The handles are opened by the torque spring so that the pair of scissors is closed. The handle defines a groove for receiving one of the slides, a slot in communication with the groove and an aperture in communication with the slot. The handle defines another groove for receiving one of the slides, another slot in communication with the groove and another aperture in communication with the slot. A spring is inserted in the recess of each of the slides. There are two latches each including a first end inserted in one of the springs, a second end exposed from the slot and a locking section for insertion in the aperture. The springs are compressed between the slides and the locking sections. Two threaded bolts are driven into the screw holes of each of the slides. The heads of the threaded bolts retain the locking sections. In operation, the blades are extended from the handles. The locking sections are located in the apertures. A user can close the handles to close the blades for shearing. A user can push the latches by the second ends to move the locking sections from the apertures. Thus, the blades can be retracted into the handles for storage.

Several problems have been encountered in using this conventional shearing apparatus. Firstly, while closing the handles, the user might push the latches by the second ends and allow the insertion of the blades into the handles by mistake. Such unexpected insertion interrupts the normal operation and might hurt the user.

Secondly, there is no device for retaining the blades in the handles. The blades might be extended from the handles by mistake. Such unexpected extension might damage things and/or hurt the user.

Thirdly, the shanks are short. Therefore, it requires a large force to close the blades.

The present invention is therefore intended to obviate or at least alleviate the problems encountered in the prior art.

SUMMARY OF INVENTION

According to the present invention, a shearing apparatus includes a pair of scissors including a first blade, a second blade, a first slide on the first blade and a second slide on the second blade. A first handle defines a groove for receiving the first slide, a first portion through which the pair of scissors can be retracted into and extended from the first handle, a second portion, a slot and two apertures in communication with the slot. A second handle is pivotally connected to the first handle. The second handle defines a groove for receiving the second slide. A positioning device is connected to the pair of scissors. The positioning device is normally located in one of the apertures to position the pair of scissors and can be pushed and then moved between the apertures along the slot to move the pair of scissors.

An advantage of the shearing apparatus of the present invention is to avoid unexpected extension or retraction of the pair of scissors since there are two apertures at the ends of the slot, respectively for positioning the positioning device and therefore the pair of scissors.

Another advantage of the shearing apparatus of the present invention is to avoid unexpected pushing of the latch while closing the first and second handles since the direction in which the latch is pushed is different from the direction in which the first and second handles are closed.

Another advantage of the shearing apparatus of the present invention is to require only a small force to close the first and second blades since the first and second handles can be deemed extensions of shanks of the first and second blades, respectively.

Other advantages and features of the present invention will become apparent from the following description referring to the drawings.

BRIEF DESCRIPTION OF DRAWINGS

The present invention will be described through detailed illustration of several embodiments referring to the drawings.

DETAILED DESCRIPTION OF EMBODIMENTS

Figure 1:
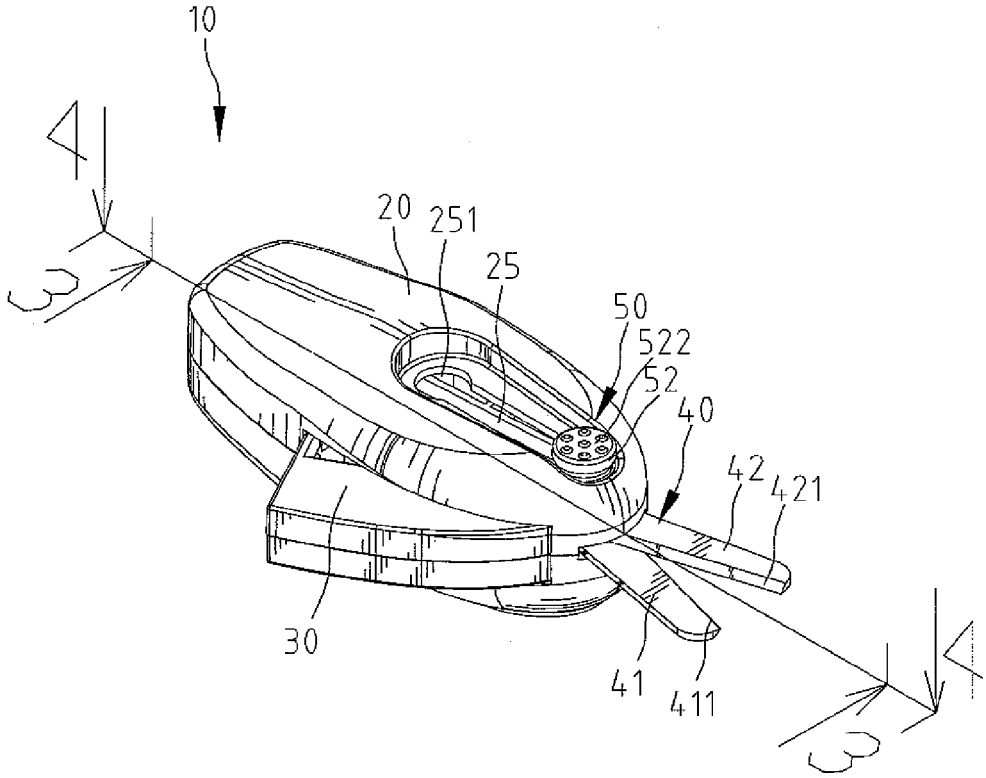
FIG. 1 is a perspective view of a shearing apparatus according to a first embodiment of the present invention.

Referring to FIGS. 1 through 8, there is shown a shearing apparatus 10 according to a first embodiment of the present invention. The shearing apparatus 10 includes a pair of scissors 40, a first handle 20, a second handle 30 and a positioning device 50 for positioning the pair of scissors 40 relative to the handles 20 and 30.

Figure 2:
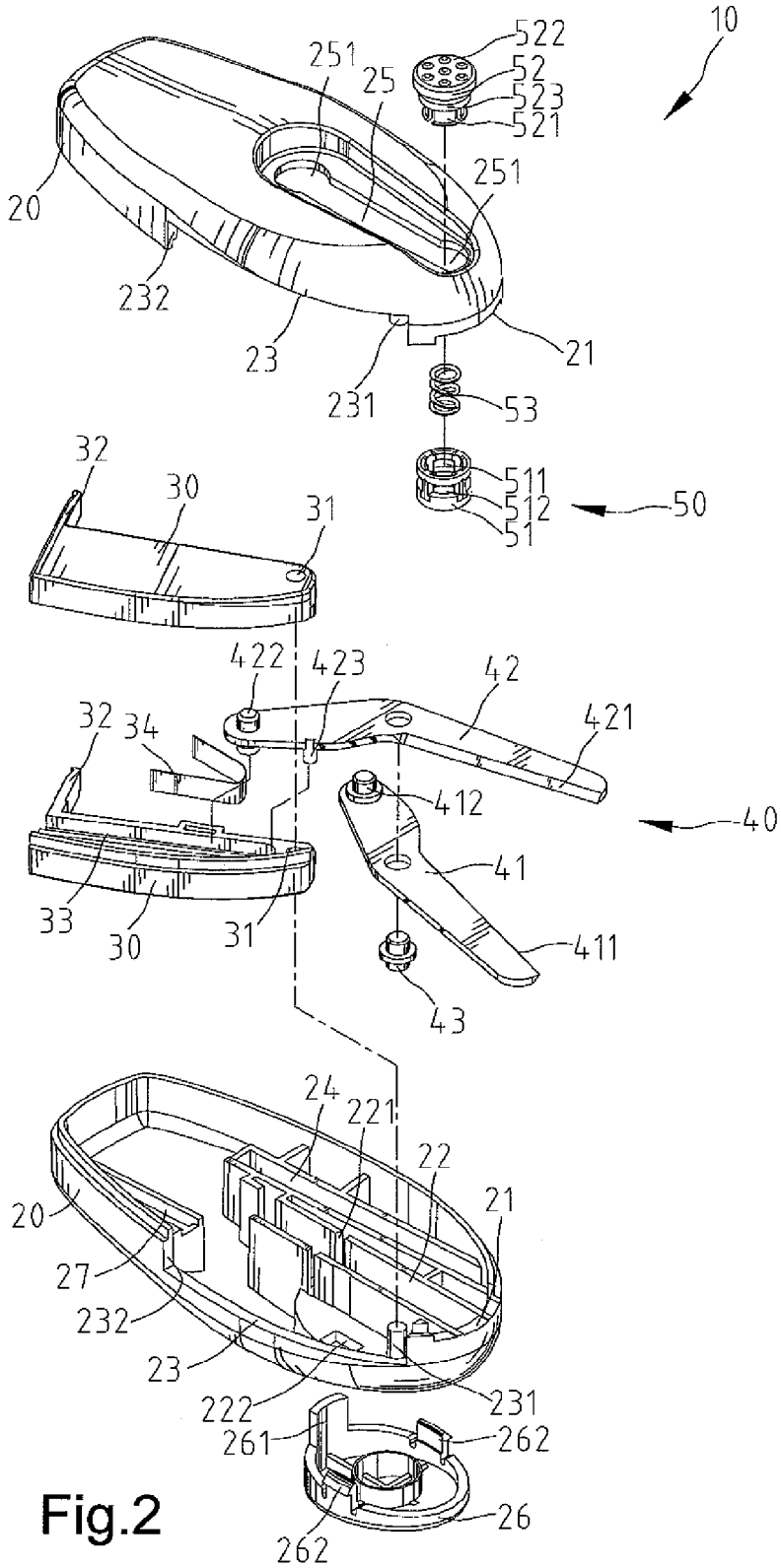
FIG. 2 is an exploded view of the shearing apparatus shown in FIG. 1.

Referring to FIG. 2, the pair of scissors 40 includes a first blade 41 and a second blade 42. The first blade 41 includes a cutting edge 411 formed at an end, a shank formed at an opposite end and a slide 412 formed on the shank. The second blade 42 includes a cutting edge 421 formed at an end, a shank formed at an opposite end, a main slide 422 and an auxiliary slide 423 both formed on the shank.

The first handle 20 includes an oval profile. The first handle 20 consists of two halves joined in any proper manner. The first handle 20 includes a first groove 24 defined therein, a second groove 27 defined therein, a third groove 22 defined therein between the first groove 24 and the second groove 27, a slot 25 in communication with the third groove 22, a first aperture 251 in communication with the slot 25, a second aperture 251 in communication with the slot 25, a first portion 21 in communication with the third groove 22, a second portion 23 defined therein near the first portion 21, a slit 221 in communication with the third groove 22 and two slits 222 defined therein. The first handle 20 includes a shaft 231 formed on the interior near an end of the second portion 23 and a restraining portion 232 formed at an opposite end of the second portion 23.

There is a restraint 26 including a tab 261 formed on a side and two hooks 262 formed on the side.

The second handle 30 includes two haves joined by any proper means. The second handle 30 includes an aperture 31 defined in an end, a hook 32 formed at an opposite end and a groove 33 defined therein.

The positioning device 50 includes a latch 52, a ring 51 and an elastic element 53. The latch 52 includes a plurality of hooks 521 formed at an end, a button 522 formed at an opposite end and an enlarged locking position 523 formed between the hooks 521 and the button 522. The ring 51 includes a space 511 centrally defined therein and a plurality of slots 512 in communication with the space 511. The slots 512 are made corresponding to the hooks 521.

In assembly, a pivot 43 is inserted through an aperture defined in the first blade 41 and an aperture defined in the second blade 42 to pivotally connect the first blade 41 to the second blade 42. The pivot 43 is movably located in the third groove 22. The slide 412 of the first blade 41 is movably located in the first groove 24 of the first handle 20. The main slide 422 and auxiliary slide 423 of the second blade 42 are movably located in the groove 33 of the second handle 30. The cutting edges 411 and 421 can be extended from the first handle 20 and retracted into the handle 20 through the first portion 21. The width of the first portion 21 is smaller than the length of the pivot 43 to avoid the removing of the pivot 43 from the third groove 22 of the first handle 20 in a direction.

The tab 261 of the restraint 26 is inserted into the third groove 22 of the first handle 20 through the slit 221. The hooks 262 of the restraint 26 are inserted into the first handle 20 through the slits 222 for attaching the restraint 26 to the first handle 20. The tab 261 of the restraint 26 can prevent the removing of the pivot 43 from the third groove 22 of the first handle 20 in an opposite direction.

The shaft 231 of the first handle 20 is inserted in the aperture 31 of the second handle 30 so that the second handle 30 can be pivoted from the first handle 20 through the second portion 23. There is provided an elastic element 34 in the form of a bent leaf spring for pivoting the first handle 20 from the second handle 30, thus opening the pair of scissors 40. The hook 32 of the second handle 30 can hook the restraining portion 232 of the first handle 20 to prevent excessive pivoting of the second handle 30 from the first handle 20.

The pivot 43 is inserted in the space 511 of the ring 51 so that the pair of scissors 40 will be moved when the ring 51 is moved. The elastic element 53 is located in the space 511 of the ring 51. The hooks 521 of the latch 52 are inserted into the slots 512 through the space 511 of the ring 51 and the first or second aperture 251 of the first handle 20. The elastic element 53 is compressed between the latch 52 and the pair of scissors 40. Because of the elastic element 53, the locking section 523 of the latch 52 is kept in the first or second aperture 251 of the first handle 20.

Figure 3:
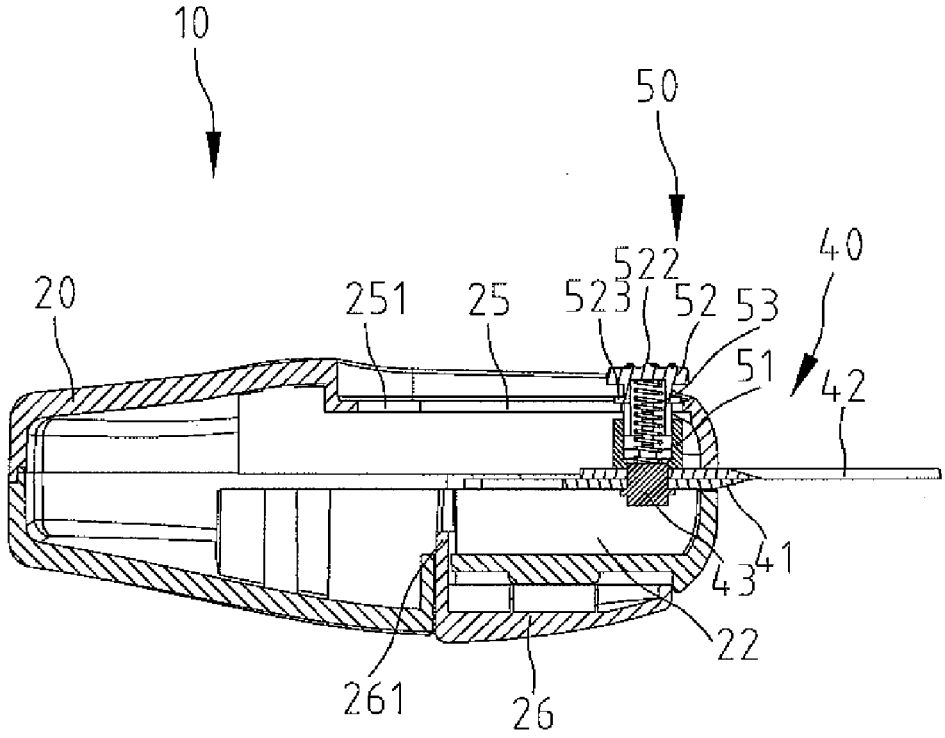
FIG. 3 is a cross-sectional view of the shearing apparatus taken along a line 3-3 in FIG. 1.
Figure 4:
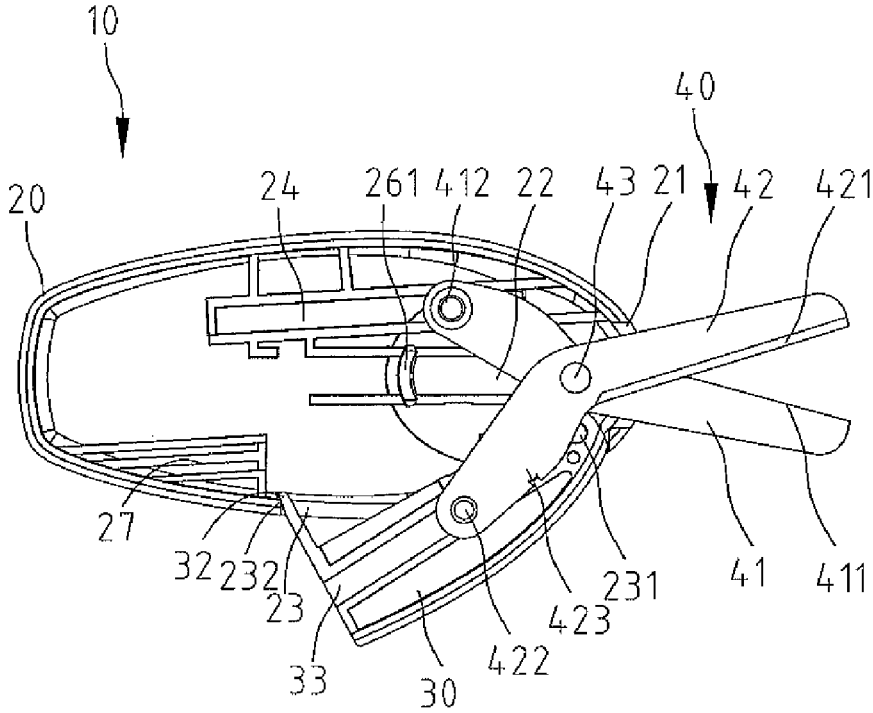
FIG. 4 is a cross-sectional view of the shearing apparatus taken along a line 4-4 in FIG. 1.

Referring to FIGS. 3 and 4, the cutting edges 411 and 421 are extended from the first handle 20 through the first portion 21. The locking section 523 of the latch 52 is located in the first aperture 251. Hence, the cutting edges 411 and 421 are retained in the extended position.

Figure 5:
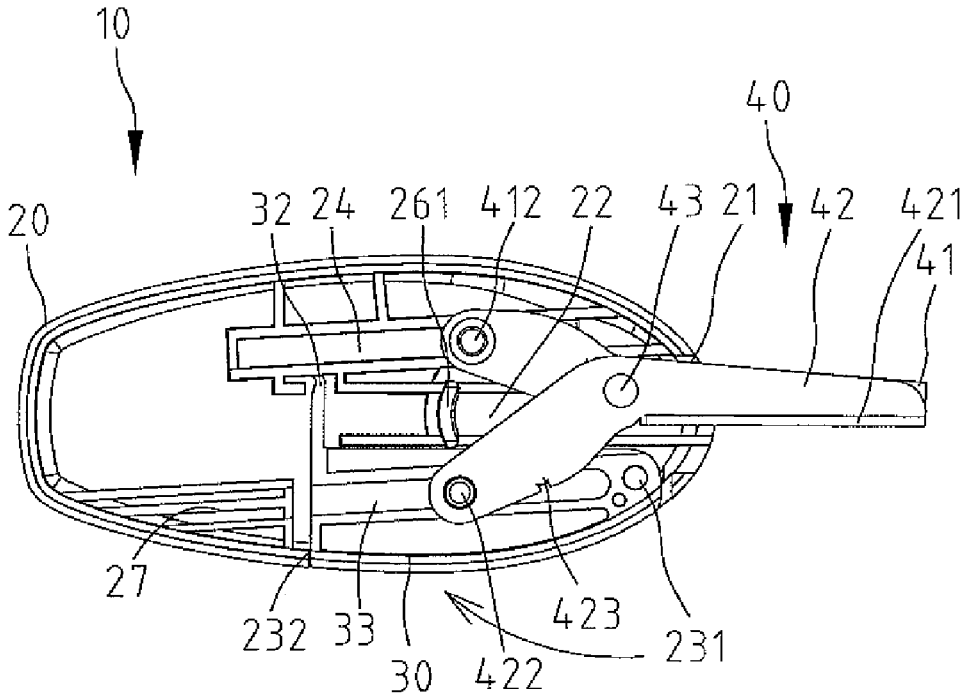
FIG. 5 is a cross-sectional view of the shearing apparatus in another position than shown in FIG. 4.
Figure 6:
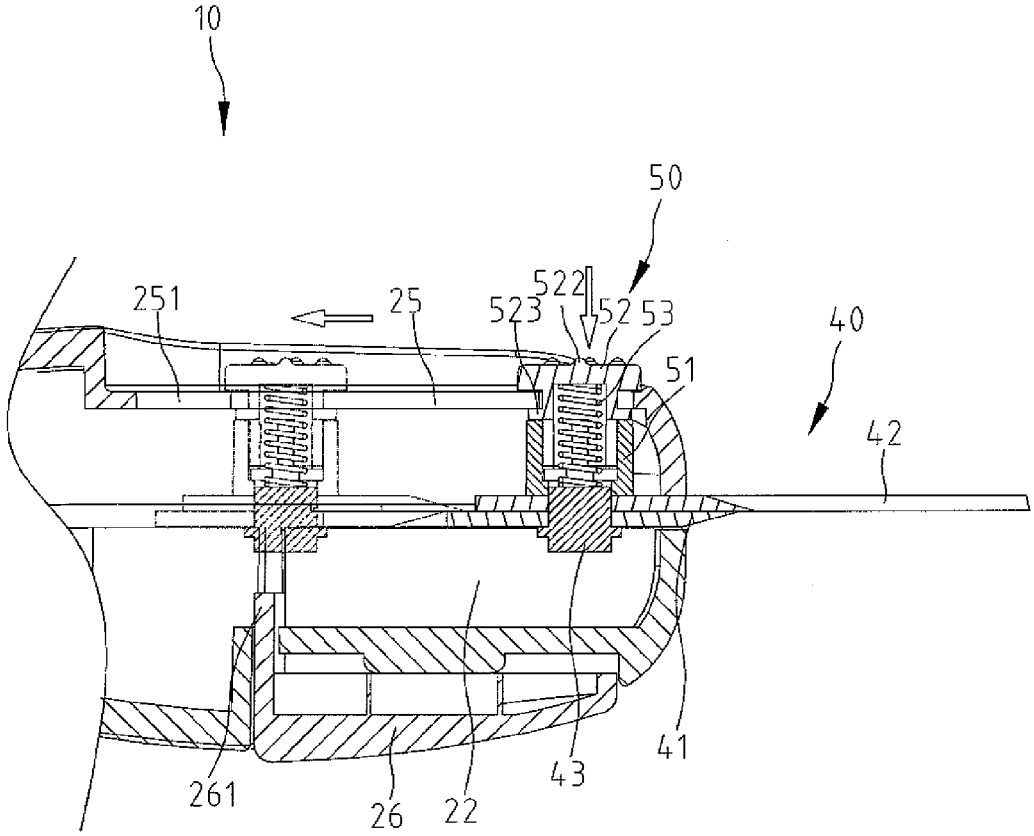
FIG. 6 is a partial cross-sectional view of the shearing apparatus in another position than shown in FIG. 3.

Referring to FIGS. 5 and 6, the button 522 of the latch 52 is pushed to allow the removing of the locking section 523 of the latch 52 from the first aperture 251 of the first handle 20. The elastic element 53 is loaded. The handles 20 and 30 are closed. Along the slot 25, the latch 52 is moved from the first aperture 251 into the second aperture 251. The ring 51 is moved by the latch 52. The pivot 43 is moved by the ring 51. The pair of scissors 40 is retracted into the first handle 20 by the pivot 43.

Figure 7:
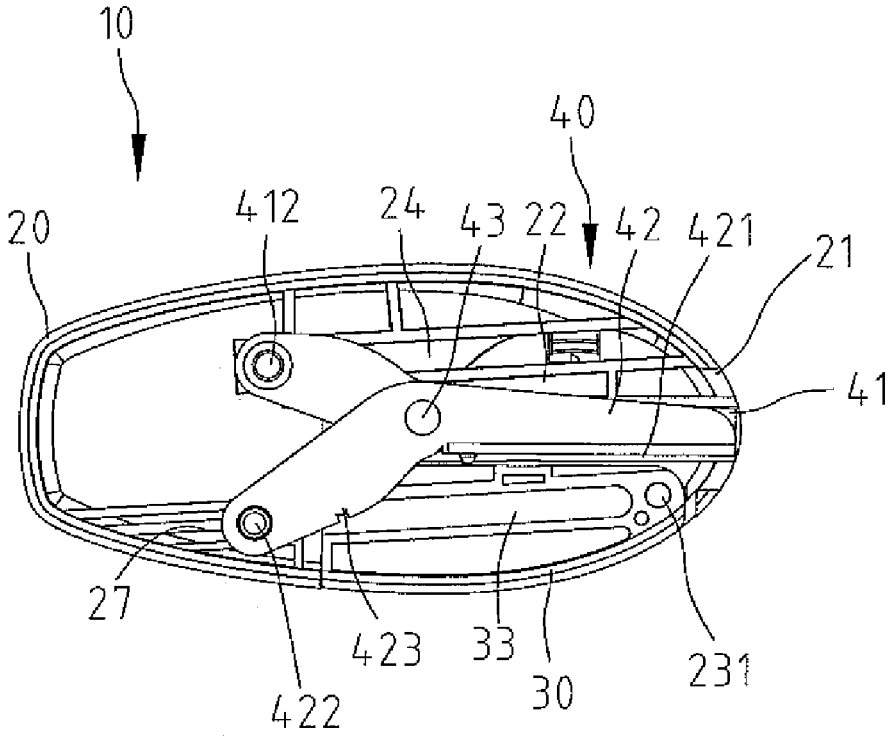
FIG. 7 is a cross-sectional view of the shearing apparatus in another position than shown in FIG. 1.
Figure 8:
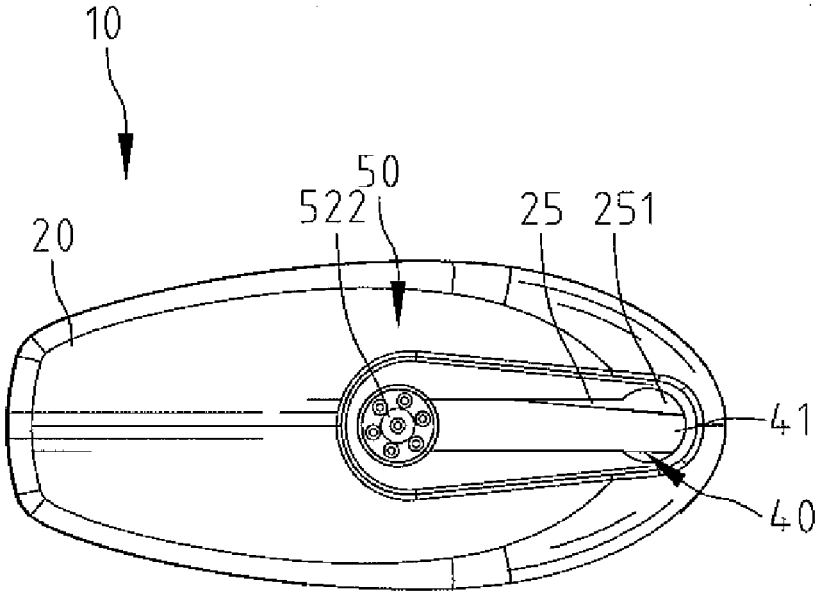
FIG. 8 is a perspective view of the shearing apparatus shown in FIG. 7.

Referring to FIGS. 7 and 8, the button 522 of the latch 52 is released so that the locking section 523 of the latch 52 is moved into the second aperture 251 by the elastic element 53. Therefore, the pair of scissors 40 is retained in the retracted position. The main slide 422 is moved into the second groove 27 of the first handle 20 from the groove 33 of the second handle 30 so that the pair of scissors 40 is retained in the closed position.

Figure 9:
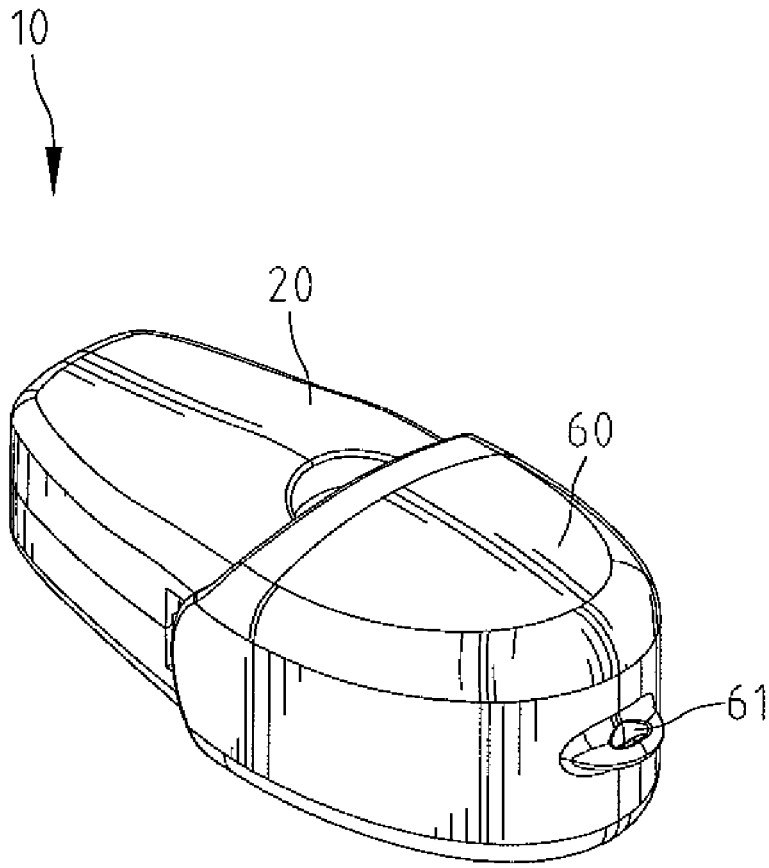
FIG. 9 is a perspective view of a shearing apparatus according to a second embodiment of the present invention.
Figure 10:
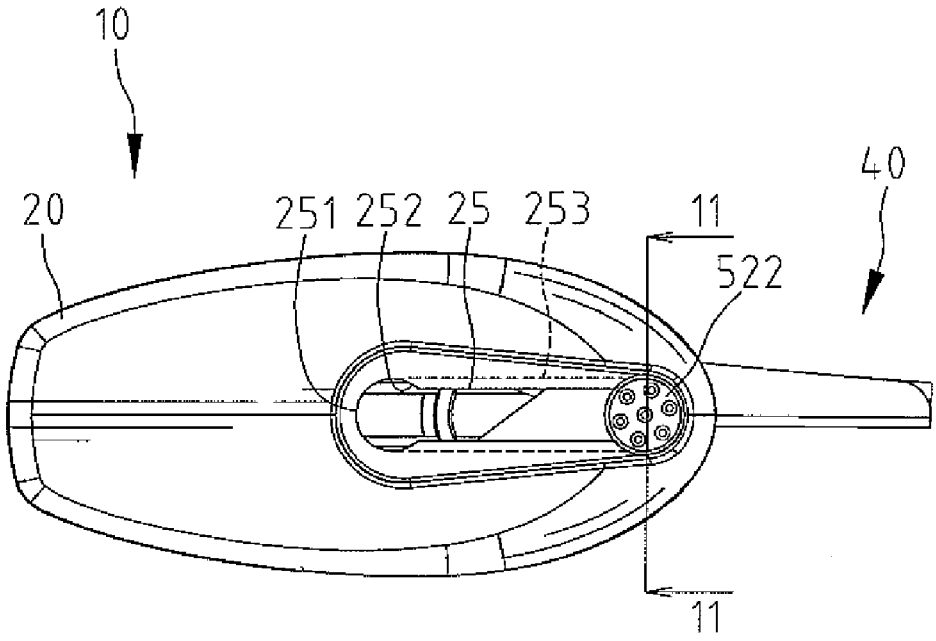
FIG. 10 is a top view of shearing apparatus according to a third embodiment of the present invention.
Figure 11:
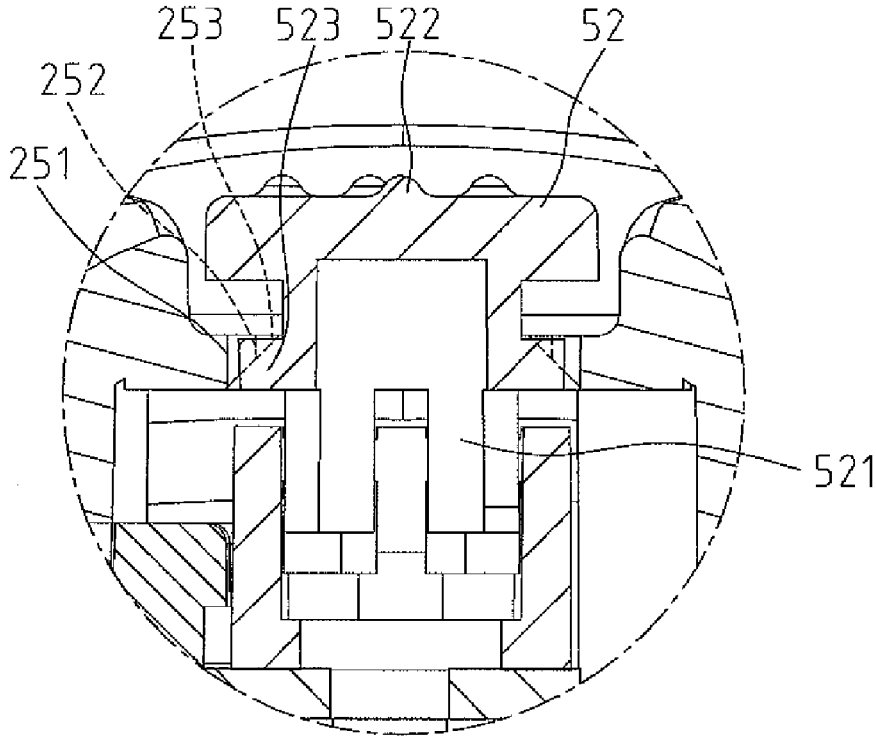
FIG. 11 is a partial cross-sectional view of the shearing apparatus taken along a line 11-11 in FIG. 10.

Referring to FIG. 9, there is shown a shearing apparatus according to a second embodiment of the present invention. The second embodiment is like the first embodiment except including a cap 60 for covering the first handle 20, the second handle 30, the pair of scissors 40 and the positioning device 50. The positioning device 50 is protected from external articles. The cap 60 shuts both of the first portion 21 and the second portion 23 to protect the first handle 20 from external articles. The cap 60 includes a lug 61 for engagement with a loop or key ring so that the shearing apparatus can conveniently be carried.

Referring to FIGS. 10 through 13, there is shown a shearing apparatus according to a third embodiment of the present invention. The third embodiment is like the first embodiment except that the slot 25 is defined between two inclined banks 253 for smooth movement of the locking section 523 of the latch 52 into the slot 25 from the first aperture 251. The inclined banks 253 at least extend in a transitional zone 252 between the slot 25 and the first aperture 251.

Figure 12:
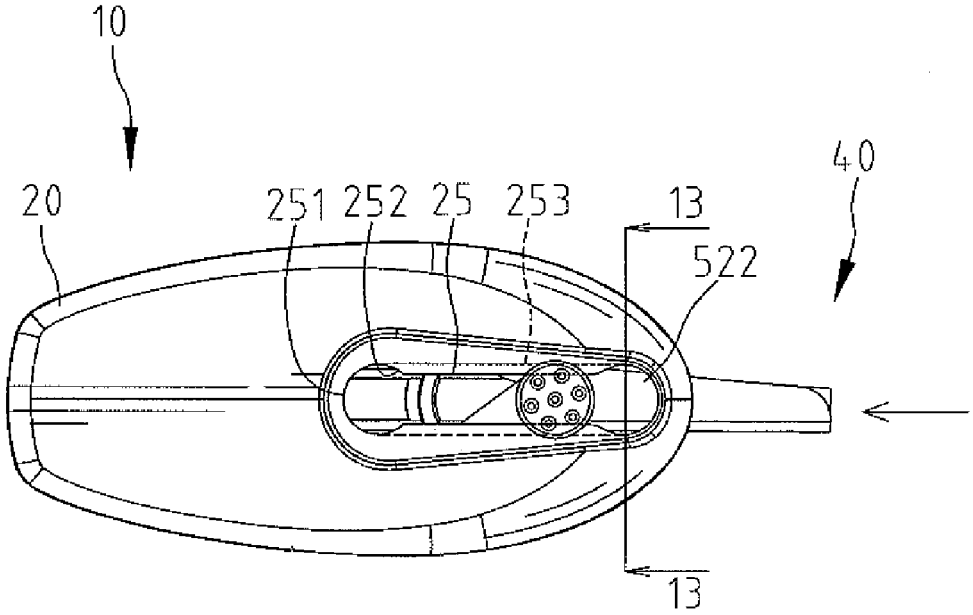
FIG. 12 is a top view of the shearing apparatus in another position than shown in FIG. 10.
Figure 13:
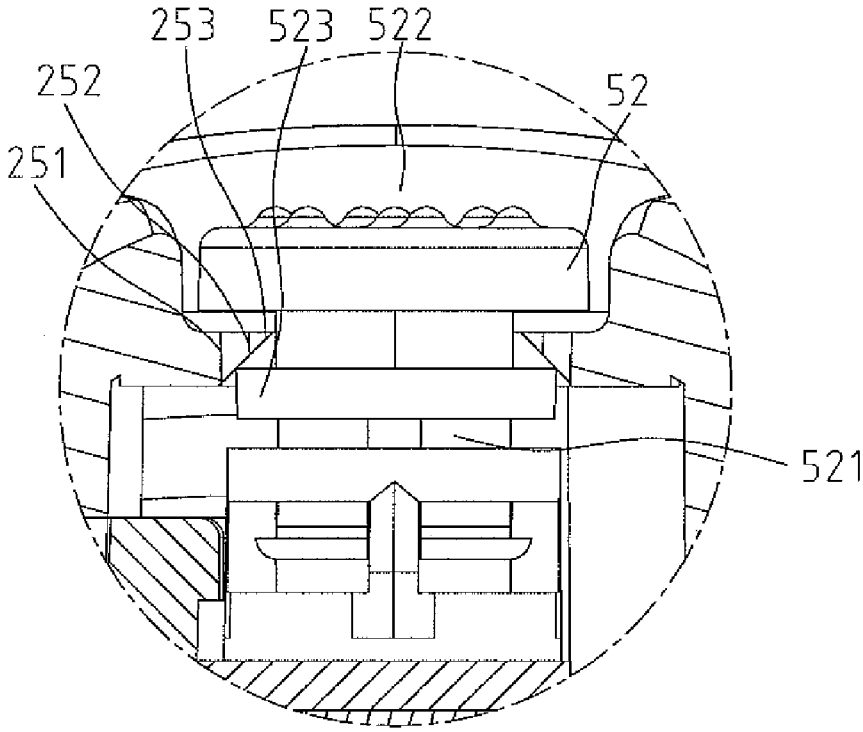
FIG. 13 is a cross-sectional view of the shearing apparatus taken along a line 13-13 in FIG. 12.

As clearly shown in FIGS. 12 and 13, the pair of scissors 40 is subject to an external force and retracted into the first handle 20 since the locking section 523 of the latch 52 is guided into the slot 25 from the first aperture 251 by the inclined banks 253. The third embodiment is advantageous in protecting people from the pair of scissors 40.

Figure 14:
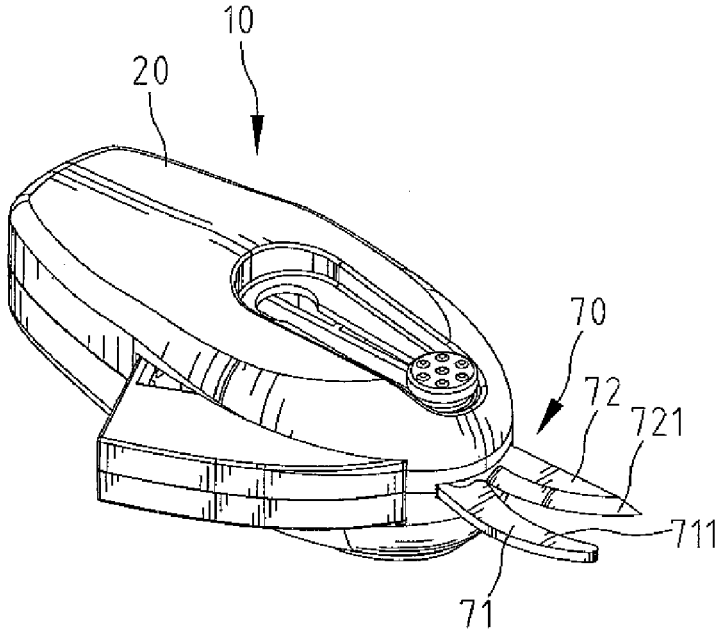
FIG. 14 is a perspective view of a shearing apparatus according to a fourth embodiment of the present invention.

Referring to FIG. 14, there is shown a shearing apparatus according to a fourth embodiment of the present invention. The fourth embodiment is like the first embodiment except including a pair of scissors 70 instead of the pair of scissors 40. The pair of scissors 70 includes two blades 71 and 72. The blades 71 and 72 are like the blades 41 and 42 except including arched cutting edges 711 and 721 instead of the straight cutting edges 411 and 421.

The shearing apparatus of the present invention exhibits several advantages. Firstly, there are two apertures 251 at the ends of the slot 25, respectively for positioning the latch 52 and therefore the pair of scissors 40 or 70. The pair of scissors 40 or 70 will not be extended or retracted by mistake.

Secondly, the direction in which the latch 52 is pushed is different from the direction in which the handles 20 and 30 are closed. Hence, it is not likely to push the latch 52 by mistake while closing the handles 20 and 30.

Thirdly, the handles 20 and 30 can be deemed extensions of the shanks of the blades 41 and 42, or 71 and 72, respectively. Therefore, it only requires a small force to close the blades 41 and 42, or 71 and 72.

The present invention has been described via the detailed description of the embodiments. Those skilled in the art can derive variations from the embodiments without departing from the scope of the present invention. Therefore, the embodiments shall not limit the scope of the present invention defined in the claims.

What is claimed is:

1. A shearing apparatus comprising:

a pair of scissors comprising a first blade, a second blade, a first slide on the first blade and a second slide on the second blade;

a first handle defining a groove for receiving the first slide, a first portion through which the pair of scissors can be retracted into and extended from the first handle, a second portion, a slot and two apertures in communication with the slot;

a second handle pivotally connected to the first handle, the second handle comprising a groove for receiving the second slide; and a positioning device connected to the pair of scissors, wherein the positioning device is normally located in one of the two apertures to position the pair of scissors and can be pushed and then moved between the two apertures along the slot to move the pair of scissors, wherein the first handle comprises an auxiliary groove for receiving the second slide when the pair of scissors is closed and retracted.

2. The shearing apparatus according to claim 1 wherein a direction in which the positioning device is pushed is different from a direction in which the first and second handles are closed.

3. The shearing apparatus according to claim 1 wherein the pair of scissors comprises a pivot for pivotally connecting the first blade to the second blade.

4. The shearing apparatus according to claim 3 further comprising a controlling device connected to the pivot.

5. The shearing device according to claim 4 wherein the controlling device comprises a ring for receiving the pivot and a latch with a first end connected to the ring and a second end exposed from the shell through the slot and the two apertures.

6. The shearing apparatus according to claim 5 wherein the latch comprises a locking section that can be located in one of the two apertures to position the pivot and removed from the two apertures to allow the movement of the pivot.

7. The shearing apparatus according to claim 5 wherein the positioning device comprises an elastic element compressed between the ring and the latch.

8. The shearing apparatus according to claim 3 wherein the first handle defines another groove for receiving the pivot.

9. The shearing apparatus according to claim 1 wherein the pair of scissors comprises an auxiliary slide on the second blade for sliding in the groove of the second handle so that the second slide can smoothly be moved into the auxiliary groove of the first handle from the groove of the second handle.

10. The shearing apparatus according to claim 1 wherein the first handle comprises a shaft on an interior near the second portion, wherein the second handle defines an aperture for receiving the shaft.

11. The shearing apparatus according to claim 1 wherein the first handle comprises a restraining portion next to the second portion, wherein the second handle comprises a hook for hooking the restraining portion, thus avoiding excessive opening of the first and second handles.

12. The shearing apparatus according to claim 1 comprising an elastic element compressed between the first and second handles.

13. The shearing apparatus according to claim 12 wherein the elastic element is a bent leaf spring.

14. The shearing apparatus according to claim 1 wherein the first and second blades comprise straight cutting edges.

15. The shearing apparatus according to claim 1 wherein the first and second blades comprises arched cutting edges.

16. A shearing apparatus comprising:

a pair of scissors comprising a first blade, a second blade, a first slide on the first blade and a second slide on the second blade;

a first handle defining a groove for receiving the first slide, a first portion through which the pair of scissors can be retracted into and extended from the first handle, a second portion, a slot and two apertures in communication with the slot;

a second handle pivotally connected to the first handle, the second handle comprising a groove for receiving the second slide;

a positioning device connected to the pair of scissors, wherein the positioning device is normally located in one of the two apertures to position the pair of scissors and can be pushed and then moved between the two apertures along the slot to move the pair of scissors, wherein the pair of scissors comprises a pivot for pivotally connecting the first blade to the second blade; and a controlling device connected to the pivot, wherein the controlling device comprises a ring for receiving the pivot and a latch with a first end connected to the ring and a second end exposed from a shell through the slot and the two apertures, wherein the ring defines a plurality of slots, wherein the latch comprises a plurality of hooks at the first end and located in the plurality of slots for hooking the ring and a button at the second end.

17. The shearing apparatus according to claim 16 comprising a cap for covering the first and second handles, the pair of scissors and the controlling device.

18. The shearing apparatus according to claim 17 wherein the cap comprises a lug thereon for engagement with one of a loop and a key ring.

19. A shearing apparatus comprising:

a pair of scissors comprising a first blade, a second blade, a first slide on the first blade and a second slide on the second blade;

a first handle defining a groove for receiving the first slide, a first portion through which the pair of scissors can be retracted into and extended from the first handle, a second portion, a slot and two apertures in communication with the slot;

a second handle pivotally connected to the first handle, the second handle comprising a groove for receiving the second slide; and a positioning device connected to the pair of scissors, wherein the positioning device is normally located in one of the two apertures to position the pair of scissors and can be pushed and then moved between the two apertures along the slot to move the pair of scissors, wherein the slot comprises two inclined banks extending in at least a transitional zone between the slot and one of the two apertures.

* * * * *